US007201612B1

(12) United States Patent
Hou

(10) Patent No.: US 7,201,612 B1
(45) Date of Patent: Apr. 10, 2007

(54) HIGH AMPERAGE ELECTRICAL CONNECTOR

(76) Inventor: Barry Hou, 289 S. Santa Anita Ave., Pasadena, CA (US) 91107

( * ) Notice: Subject to any disclaimer, the term of this patent is extended or adjusted under 35 U.S.C. 154(b) by 0 days.

(21) Appl. No.: 11/431,842

(22) Filed: May 11, 2006

(51) Int. Cl.
*H01R 13/64* (2006.01)

(52) U.S. Cl. ..... 439/680; 439/281; 439/678

(58) Field of Classification Search ..... 439/678–681, 439/280–281
See application file for complete search history.

(56) References Cited

U.S. PATENT DOCUMENTS 3,522,575 A * 8/1970 Johnson et al. ..... 439/281
3,594,696 A * 7/1971 Witek, Jr. ..... 439/278
4,284,312 A * 8/1981 Patchett et al. ..... 439/281
5,533,915 A 7/1996 Deans
5,674,094 A * 10/1997 Hutchinson et al. ..... 439/680
6,976,885 B2 * 12/2005 Lord ..... 439/680
2006/0172609 A1 * 8/2006 Wang et al. ..... 439/680

FOREIGN PATENT DOCUMENTS

EP 223586 A2 * 5/1987

* cited by examiner

*Primary Examiner*—Michael C. Zarroli
(74) *Attorney, Agent, or Firm*—William W. Haefliger

(57) ABSTRACT

A two part electrical connector is configured for high amperage transmission. It includes:
a primary non-electrically conductive body
first and second electrically conductive connector pins
a secondary non-electrically conductive body
third and fourth electrically conductive sleeves.

15 Claims, 4 Drawing Sheets

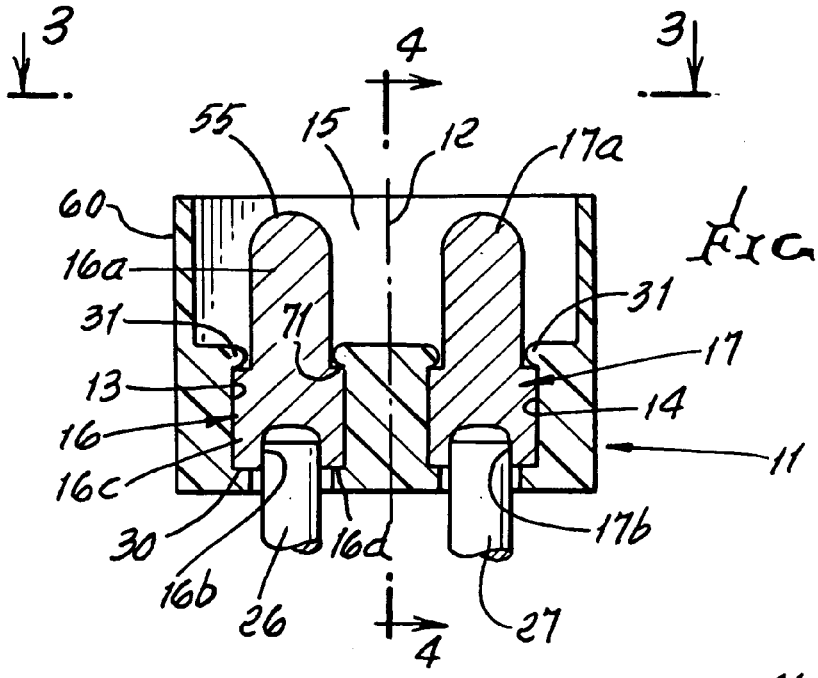
FIG. 2.
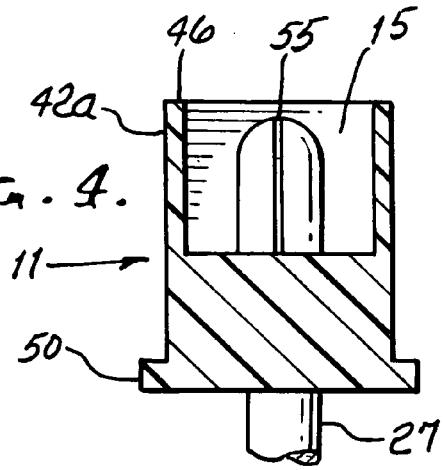
FIG. 4.
FIG. 3.
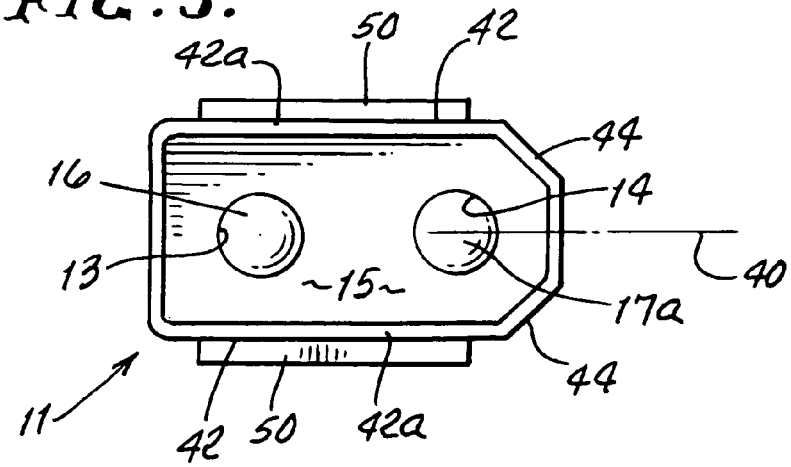

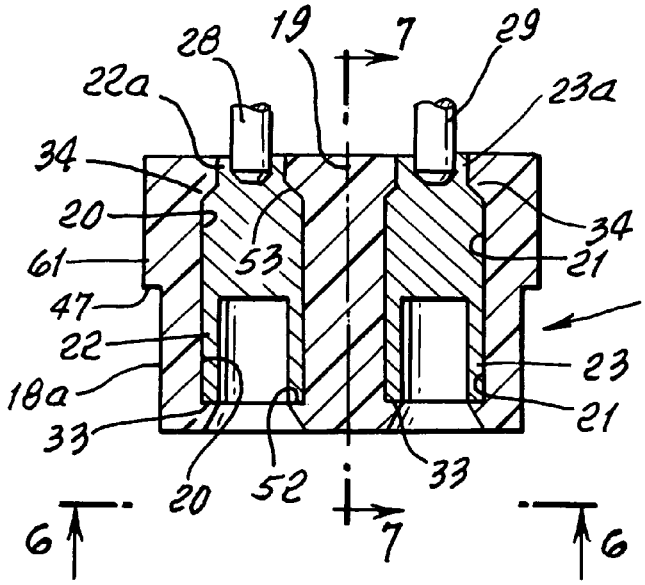
FIG. 5.
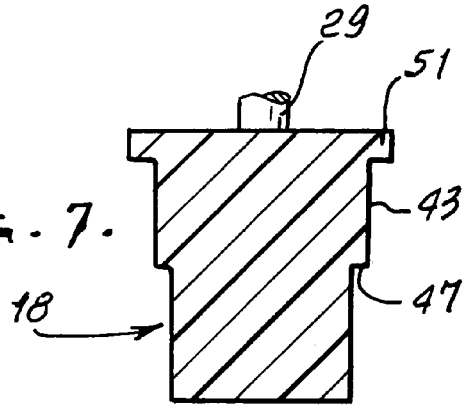
FIG. 7.
FIG. 6.
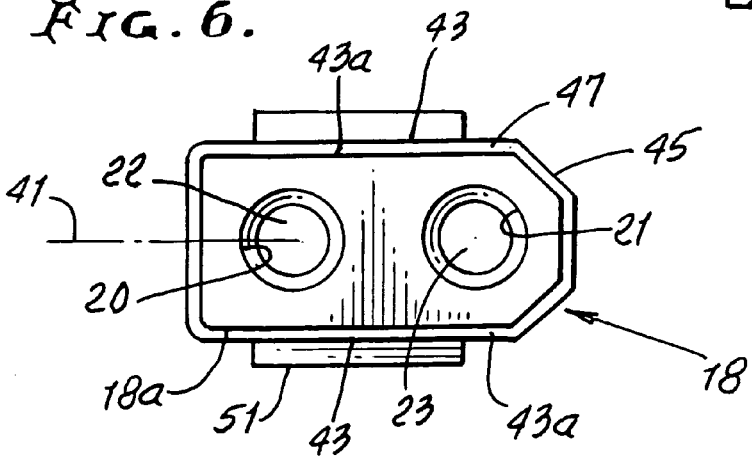

HIGH AMPERAGE ELECTRICAL CONNECTOR

BACKGROUND OF THE INVENTION

This invention relates generally to electrical plugs, and more particularly to high amperage transmitting plugs, of simple, effective, and easy to connect and disconnect construction.

There is need for electrical plugs having the above advantages, especially in small plug sizes; there is also need for such plugs operable in systems that include a battery source of electrical current; a speed controller for a vehicle, such as a model airplane or other vehicle; and a battery charger, as will be shown.

SUMMARY OF THE INVENTION

It is a major object of the invention to provide an improved connector meeting the above needs. Basically, the connector comprises:

a) a primary non-electrically conductive body having a primary longitudinal axis, and first and second through holes at opposite sides of that axis and extending parallel to the axis, there being a re-entrant cavity in the body; intersected by the axis, and in direct alignment with the first and second holes, b) first and second electrically conductive members such as connector pins received and retained in the first and second through holes, and having end portions projecting into the cavity, c) a secondary non-electrically conductive body having a secondary longitudinal axis extending in the same direction in the primary axis, and third and fourth through holes at opposite sides of the secondary axis, and extending parallel to the secondary axis, d) third and fourth electrically conductive members such as sleeves received in the third and fourth through holes, the pin end portions slidably fitting into the sleeves for establishing good cylindrical electrical contact, the secondary body having a guide section thereof slidably and guidedly fitting into the cavity for guiding reception of the pins end portions into the sleeves, e) the pins and sleeves having end extents located remotely from the cavity, first and second of those end extents associated with the pins configured for electrical connection to first and second electrical conductors, and also including third and fourth of the end extents associated with the sleeves configured for electrical connection to third and fourth electrical conductors.

Another object includes provision of shoulders integral with the primary body adjacent said first and second openings and acting to retain the pins in position endwise in the primary body; and provision of shoulders integral with the secondary body and acting to retain the sleeves in position endwise in the secondary body. As will appear, such shoulders preferably consist of molded plastic material, and are associated with the through openings as referred to. The shoulders may advantageously consist of thin deformable plastic material, as when the pins or sleeves are endwise fitted into the through openings.

A further object includes provision of such bodies to be elongated transversely in lateral planes containing said axes. In this regard the bodies may have longitudinally extending longitudinally complementary sides spaced laterally from the longitudinal axes, those sides defining longitudinally extending ridges.

Another object is to provide pin shoulders presented longitudinally to engage certain of the body shoulders; as well as sleeve shoulders presented longitudinally to engage certain of the body shoulders. The pins are typically cylindrical and have dome shaped terminals received in the sleeves, and located for guiding pin entrance into the sleeves. In a modified embodiment, the pins contain longitudinally extending slits, intersecting said dome shaped terminals, to facilitate good pin side wall with the sleeves.

A yet further object includes provision of a miniature such connector wherein:

the primary body has longitudinal length between 1 and 2 centimeters, the secondary body has longitudinal length between 1 and 2 centimeters, and the cavity has depth between 1.5 and 1 centimeters.

A system that with unusual advantage incorporates the invention includes a battery or batteries connected to the pins or sleeves; a battery charger connected and the sleeves or pins; and a vehicle speed controller connectible to the sleeve or pins, as will be seen.

These and other objects and advantages of the invention, as well as the details of an illustrative embodiment, will be more fully understood from the following specification and drawings, in which:

DRAWING DESCRIPTION

FIG. 1 is a perspective view showing two bodies, electrically conductive pins in one body, and electrically conductive sleeves in another body, guidedly connectible to the one body;

FIG. 1*a* is a similar but opposite perspective view;

FIG. 2 is a section taken through one of the bodies, showing pin positioning in through holes in the one (i.e. primary) body;

FIG. 3 is an end view taken on lines 3—3 of FIG. 2;

FIG. 4 is a section taken on lines 4—4 of FIG. 2;

FIG. 5 is a section taken through the other of the two connector bodies, showing sleeve positioning in two through holes in that other body;

FIG. 6 is an end view taken on lines 6—6 of FIG. 5;

FIG. 7 is a section taken on lines 7—7 of FIG. 5;

DETAILED DESCRIPTION

Figure 1:
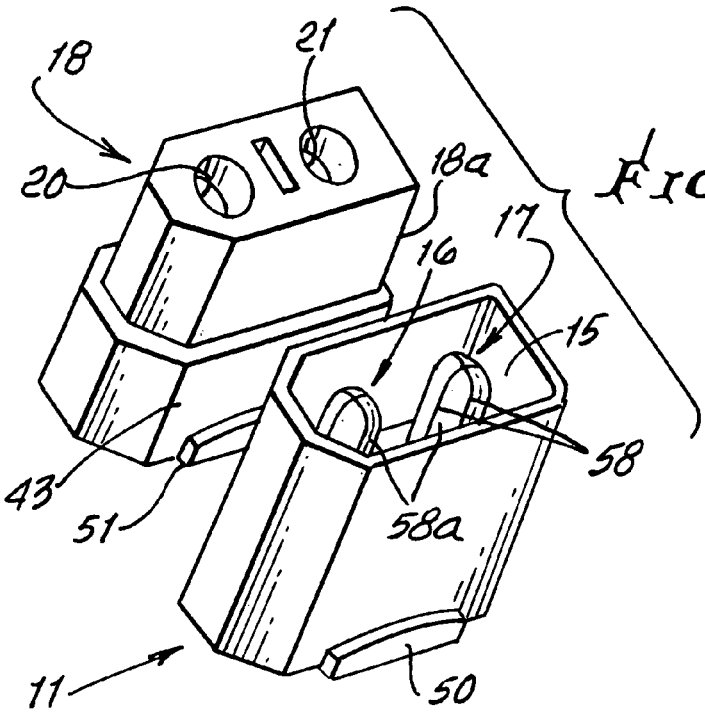
Figure 1A:
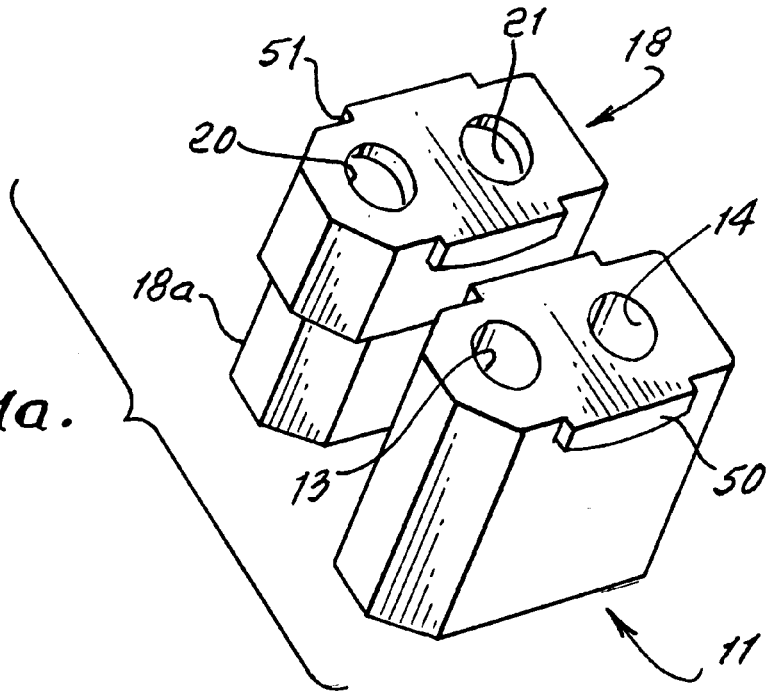
Figure 8:
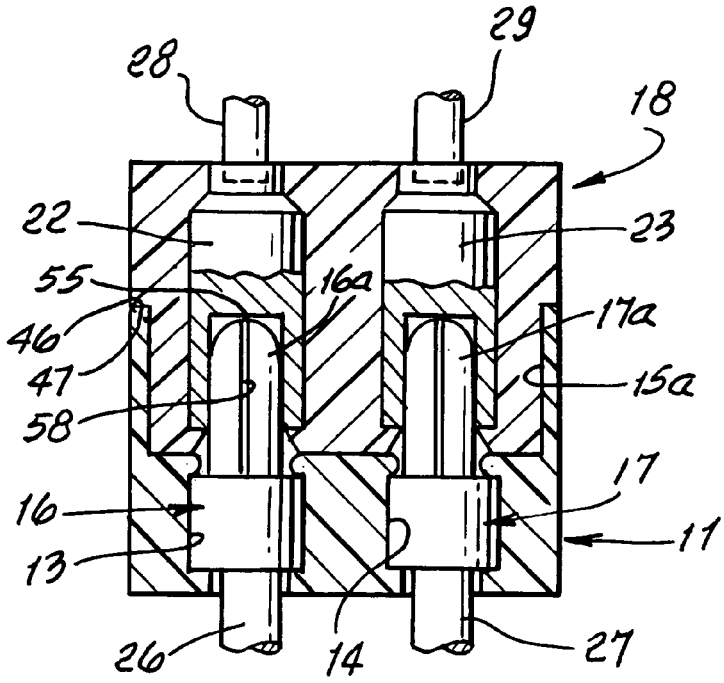
FIG. 8 shows the bodies slidably interconnected, with the pins slidably received in the sleeves.

In FIGS. 1–8 the preferred connector 10 shown comprises a) a primary non-electrically conductive (i.e. dielectric) body 11 having a primary longitudinally axis 12, and first and second through holes 13 and 14 at opposite sides of that axis and extending parallel to the axis, there being a re-entrant cavity 15 in the body and centrally intersected by the axis 12, and in direct alignment with the first and second cylindrical holes 13 and 14;

b) first and second electrically conductive elements such as connector pins 16 and 17 received and retained in the first and second through holes, and having end portions 16*a* and 17*a* projecting into the cavity, c) a secondary non-electrically conductive (i.e. dielectric) body 18 having a secondary longitudinal and central axis 19 extending in the same direction in the primary axis, and third and fourth cylindrical through holes 20 and 21 at opposite sides of secondary axis 19, and extending parallel to that secondary axis;

d) third and fourth electrically conductive elements such as sleeves 22 and 23 received in through holes 20 and 21, the pin end portions 16*a* and 17*a* slidably fitting into the sleeves, (see FIG. 8) the secondary body having a guide section 18*a* thereof slidably and guidedly fitting into the cavity 15 (engaging cavity wall 15*a*) for guiding axial reception of the pins end portions into the sleeves;

e) the pins and sleeves having end extents 16*b* and 17*b*, and 22*a* and 23*a* located remotely from the cavity 15, first and second of those end extents associated with the pins configured as shown for connection to electrical connectors 26 and 27, and third and fourth of the end extents associated with the sleeves 22*b* and 23*b* configured as shown for electrical connection to third and fourth electrical conductors 28 and 29.

Also provided are shoulders integral with the primary body adjacent the first and second openings 13 and 14 and acting to retain the pins 16 and 17, endwise, in position in the primary body. See for example shoulders 30 and 31. One or both of such shoulders may advantageously consist of molded plastic material, resiliently deformable to typically pass pins 16 and 17 endwise into position, as shown. Note convexity of shoulders 31 to allow for radial deformation as end 16*c* of pin 16 is pushed into position. Likewise, shoulders integral with the secondary body may be provided adjacent the third and fourth openings 20 and 21, and acting to retain the sleeves 22 and 23 in position, endwise, in the secondary body. See for example the shoulders 33 and 34. Once or both of such shoulders may advantageously consist of molded plastic material, resiliently deformable to forcibly pass the sleeves endwise into position, as shown. See taper of shoulders 33. The shoulders may define thin deformable projections into the openings.

The pins and sleeves typically have gold surface coatings, such as copper, for sliding, pin to sleeve contact, and allowing ready manual push-in connection and pull apart disconnection of the connector bodies. Also, the bodies typically have longitudinally extending, longitudinally complementary planar sides 60 and 61 spaced laterally from said longitudinal axes, those sides defining longitudinally extending ridges, and they may be elongated transversely in lateral planes. See for example planes 40 and 41, and also body flat sides 42 and 43 defined by the walls 42*a* and 43*a* as shown. See also angled thin sidewalls 44 and 45 on the bodies, which are longitudinally complementary for close interengagement upon endwise connection of the bodies. Body wall shoulders or ridges 46 and 47 are adapted to interengage to limit sliding connection of the bodies. Transverse projections 50 and 51 on the bodies are usable to pull the bodies apart.

The pins have shoulders 70 and 71 presented longitudinally to engage shoulders 16*d* and 31; and the sleeves have shoulders 52 and 53 presented longitudinally to engage certain body shoulders 33 and 34. The pins are generally cylindrical and have dome shaped terminals 55 that facilitate sliding entry into the sleeves. As shown in FIG. 1, those dome-shaped ends may contain longitudinally extending slits 58, allowing some radial play of the dome sections 58*a* separated by the slits, to add to the ability of the pins to slidably engage the sleeves, with full circumferential surface to surface contact, for high electrical amperage transmission.

Figure 9:
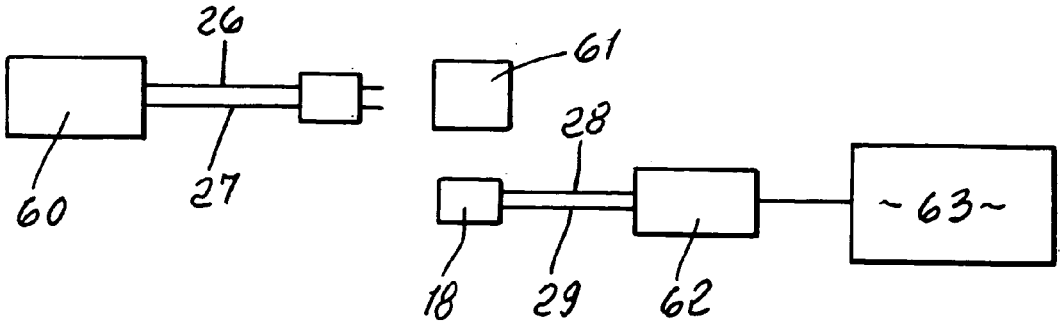
FIG. 9 is a system diagram.

FIG. 9 is a system diagram showing the connector part 11 connected in series, by wires or conductors 26 and 27, with a battery 60. Connector part 11 is alternately connectible with a battery charger 61, or with connector part 18. The latter is connected in series with ends of conductors 28 and 29. The opposite ends of 28 and 29 are connected to a control unit 62 for a vehicle such as a model airplane, or model train engine, indicated at 63.

I claim:

1. In an electrical connector, the combination comprising a) a primary non-electrically conductive body having a primary longitudinal axis, and first and second through holes at opposite sides of said axis and extending parallel to said axis, there being a re-entrant cavity in said body; intersected by said axis, and in direct alignment with said first and second holes, b) first and second electrically conductive connector pins received and retained in said first and second through holes, and having end portions projecting into said cavity, c) a secondary non-electrically conductive body having a secondary longitudinal axis extending in the same direction in said primary axis, and third and fourth through holes at opposite sides of said secondary axis, and extending parallel to said secondary axis, d) third and fourth electrically conductive sleeves received in said third and fourth through holes, said pin end portions slidably fitting into said sleeves, said secondary body having a guide section thereof slidably and guidedly fitting into said re-entrant cavity for guiding reception of the pins end portions into said sleeves, e) said pins and sleeves having end extents located remotely from said cavity, and including first and second of said end extents associated with the pins configured for electrical connection to first and second electrical conductors, and also including third and fourth of said end extents associated with the sleeves configured for electrical connection to third and fourth electrical conductors, f) there also being i) a battery or batteries electrically connected to the pins or sleeves, ii) a battery charger deployed for connection to the sleeves or pins in one body, and iii) a vehicle speed controller connected to the sleeves or pins in the other body.

2. The combination of claim 1 including shoulders integral with the primary body adjacent said first and second openings and acting to retain pins in position endwise in said primary body.

3. The combination of claim 1 including shoulders integral with the secondary body adjacent the third and fourth openings and acting to retain the sleeves in position endwise in said secondary body.

4. The combination of claim 2 wherein the body and shoulders consist of molded plastic material.

5. The combination of claim 3 wherein the shoulders consist of molded plastic material.

6. The combination of claim 4 wherein the shoulders are thin deformable projections.

7. The combination of claim 5 wherein the shoulders are thin deformable projections.

8. The combination of claim 1 wherein the pins and sleeves have gold surface coatings in sliding interengagement.

9. The combination of claim 1 wherein the bodies are elongated transversely in lateral planes containing said axes.

10. The combination of claim 9 wherein the bodies have longitudinally extending longitudinally complementary sides spaced laterally from said longitudinal axes, said sides defining longitudinally extending ridges.

11. The combination of claim 2 wherein the pins have shoulders presented longitudinally to engage certain of the body shoulders.

12. The combination of claim 3 wherein the sleeves have shoulders presented longitudinally to engage certain of the body shoulders.

13. The combination of claim 1 wherein the pins are generally cylindrical and have dome shaped terminals received in said sleeves.

14. The combination of claim 13 wherein the pins contain longitudinally extending slits, intersecting said dome shaped terminals.

15. The combination of claim 1 wherein the primary body has longitudinal length between 1 and 2 centimeters, the secondary body has longitudinal length between 1 and 2 centimeters, and the cavity has depth between 1.5 and 1 centimeters.

* * * * *